United States Patent [19]

Clow

[11] 4,109,713

[45] Aug. 29, 1978

[54] PUMPING WELL BLOW-OUT PREVENTER

[76] Inventor: Joseph Kenton Clow, 12745 Tree Ranch Rd., Ojai, Calif. 93023

[21] Appl. No.: 781,214

[22] Filed: Mar. 25, 1977

[51] Int. Cl.[2] ..... E21B 33/06; E21B 17/00

[52] U.S. Cl. ..... 166/53; 137/68 R; 166/84; 251/1 R

[58] Field of Search ..... 166/84, 80, 75, 53; 137/68 R; 251/1 R

[56] References Cited

U.S. PATENT DOCUMENTS

| | | | |
|---|---|---|---|
| 1,627,945 | 5/1927 | Wigle | 166/84 |
| 2,224,657 | 12/1940 | Rodgers | 166/80 |
| 2,563,155 | 8/1951 | Cardwell | 166/84 |
| 3,532,163 | 10/1970 | Ecuer | 166/84 |
| 3,815,925 | 6/1974 | Mattoon | 137/68 R |
| 4,064,952 | 12/1977 | Lechrer | 175/209 |

*Primary Examiner*—Ernest R. Purser
*Assistant Examiner*—William F. Pate, III
*Attorney, Agent, or Firm*—Ralph B. Pastoriza

[57] ABSTRACT

The blow-out preventer takes the form of a four-way fitting arranged to be substituted for the conventional three-way fitting in a pumping well head between the pipe string and upper stuffing box. The four-way fitting includes a spring-biased ball which will be ejected to the central portion of the fitting should the polished rod break or otherwise be ejected, the resulting oil flow urging the ball against the under entrance portion of the stuffing box to block oil flow until such time as the normal Radigan valve can be closed.

2 Claims, 4 Drawing Figures

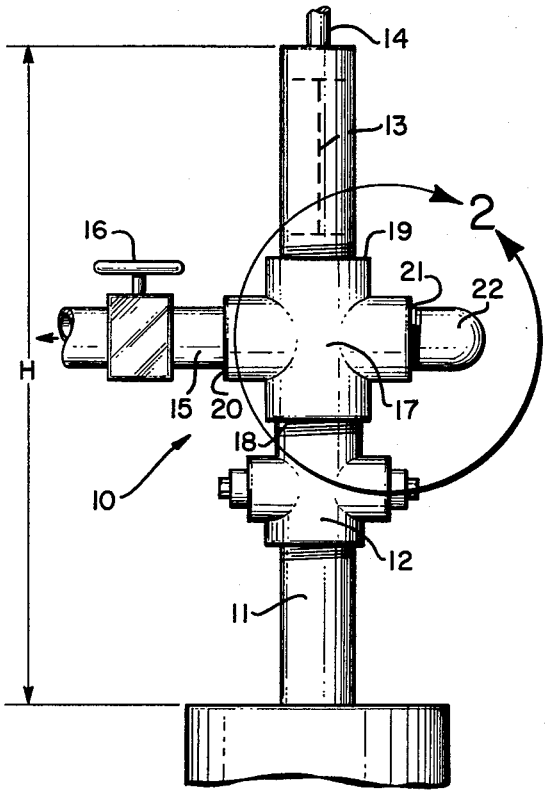
FIG. 1
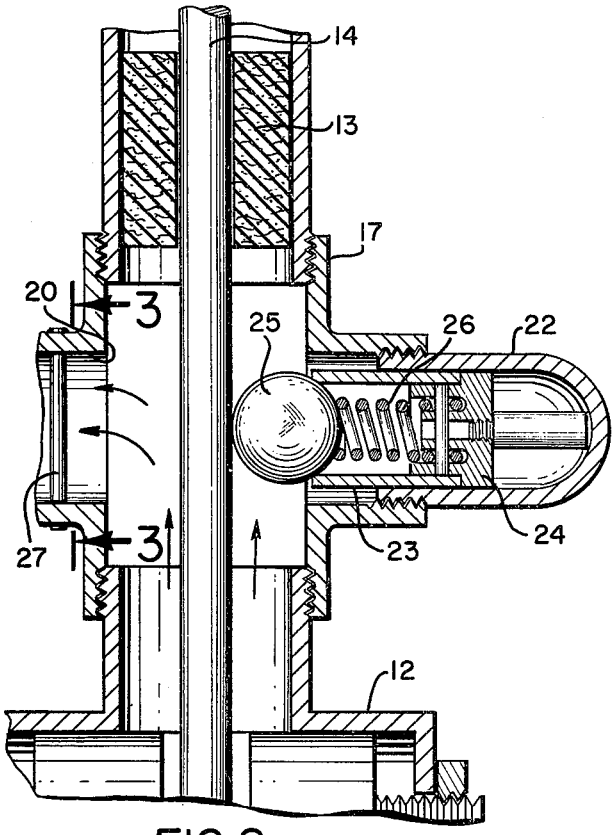
FIG. 2
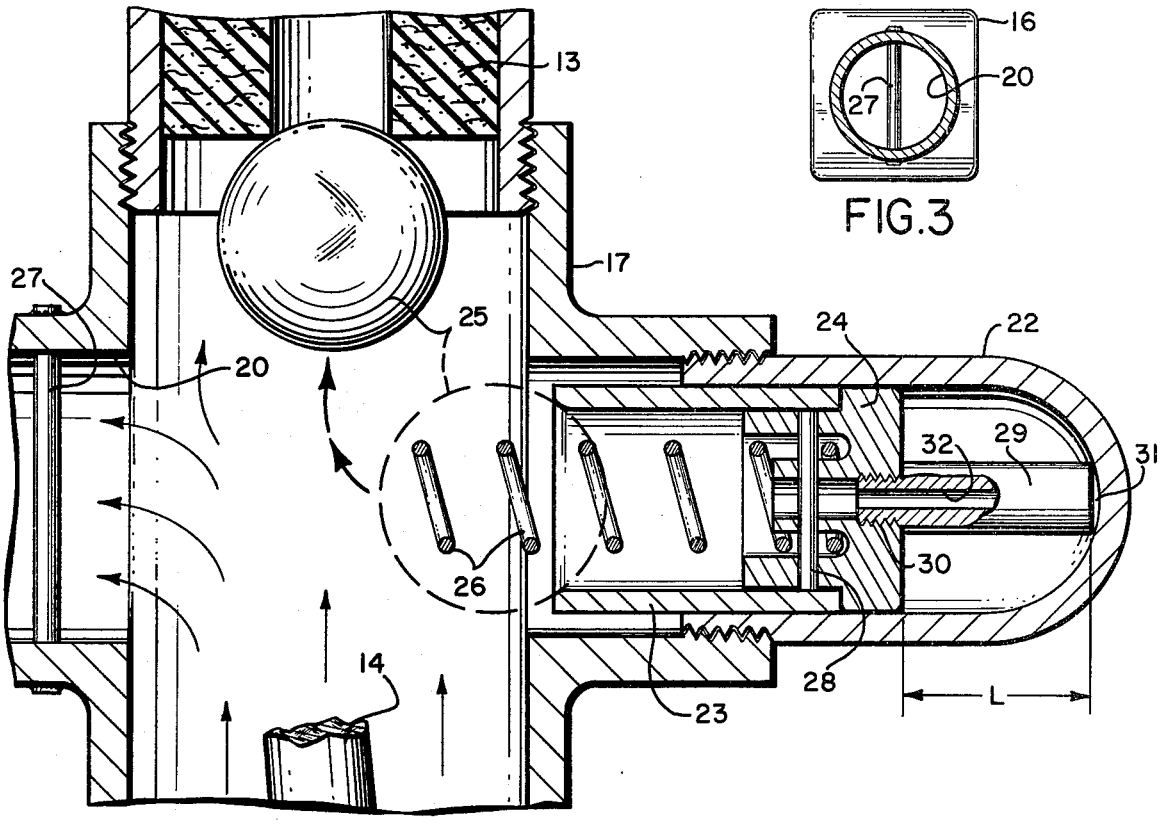
FIG. 4
FIG. 3

PUMPING WELL BLOW-OUT PREVENTER

This invention relates to oil well blow-out preventers and more particularly to an improved simplified blow-out preventer for use in the well head structure of a pumping well.

BACKGROUND OF THE INVENTION

In a normal pumping well, an oil pump is connected to the lower end of the oil well pipe string and sucker rods connected to the pump pass up through the pipe string to connect to a polished rod passing through a three-way fitting. The lower coupling of this fitting connects to the upper end of the pipe string and the axially aligned upper coupling receives a stuffing box through which the polished rod extends to connect through an appropriate clamp and carrier bar to a bridle. The bridle in turn is reciprocated upwardly and downwardly by a structure referred to in the art as a "horsehead". The lateral outlet of the three-way coupling connects to an oil flow line so that oil pumped up from the bottom of the well through the pipe string can be collected in this flow line. The stuffing box prevents oil leakage around the polished rod as it is reciprocated up and down.

In certain circumstances, the polished rod can become disconnected or break resulting in its being ejected from the stuffing box. The pumped oil under pressure will then pass up through the stuffing box and cause a substantial mess in the surrounding area not only irritating to environmentalists but involving substantial clean-up expenses.

While it is common practice to provide a Radigan type close-off valve between the lower coupling of the three-way fitting and upper end of the pipe string, such valve must be manually closed and during the period of closure, substantial amounts of oil can escape through the stuffing box.

To overcome the foregoing problem, there are available blow-out preventers arranged to be inserted above the stuffing box connecting to the upper coupling of the three-way fitting, the polished rod passing through this blow-out preventer. Essentially, the structure includes a spring biased ball bearing against the rod in such a manner that if the rod breaks and is ejected, the ball is free to seat up against a valve seat in the blow-out preventer thereby blocking passage of oil up through the stuffing box to the exterior.

The problem with the foregoing types of blow-out preventers is that the height of the well head structure itself is necessarily increased in order to insert the blow-out preventer above the upper stuffing box and the normal three-way fitting. This increased height can cause difficulties with respect to the remaining pumping components in that the distance between the exit point of the polished rod from the upper stuffing box to the carrier bar and bridle assembly is decreased. There is thus necessitated some repositioning of components involved when such blow-out preventers are used.

Another problem with such blow-out preventers is the fact that they are relatively expensive items, this expense resulting from the necessity of providing an appropriate seat for the ball which normally might take the form of an additional stuffing box.

There is a need, accordingly, for some type of blow out protection which will automatically operate should a polished rod break or be ejected from the normal stuffing box which will not only avoid any increase in height of the well head structure but also can be produced economically so that the expense to oil producers of such blow-out preventers can be reduced.

BRIEF DESCRIPTION OF THE PRESENT INVENTION

With the foregoing in mind, the present invention contemplates an improved blow-out preventer for pumping well heads which fully meets the above noted need.

More particularly, the blow out preventer of this invention takes the form of a four-way fitting dimensioned to be substituted for the normally provided three-way well head fitting. Three of the couplings on the four-way fitting connect to the pipe string, normal stuffing box and normal outlet oil well flow line while the fourth is arranged to receive a housing structure incorporating a spring biased ball.

With the foregoing arrangement, should a blow-out occur causing ejection of the polished rod, the ball is released to the central area of the four way fitting and will immediately be seated against the underside entrance portion of the normally provided stuffing box to block oil flow pending closing of the normal Radigan valve.

Not only is the height of the well head unchanged because of the simple substitution but by utilizing the already available stuffing box as a valve seat for the ball, the blow-out preventer can be produced much more economically than presently available blow-out preventers.

BRIEF DESCRIPTION OF THE DRAWINGS

A better understanding of this invention as well as further features and advantages thereof will be had by referring to the accompanying drawings in which:

FIG. 1 is a side elevational view of a typical pumping well head structure incorporating the blow-out preventer of the present invention;

FIG. 2 is an enlarged fragmentary view partly in cross section of that portion of the structure enclosed within the circular arrow 2 of FIG. 1;

FIG. 3 is a cross section taken in the direction of the arrows 3—3 of FIG. 2; and, FIG. 4 is a greatly enlarged fragmentary view partly in cross section of the blow-out preventer useful in explaining its operation.

DETAILED DESCRIPTION OF THE PREFERRED EMBODIMENT

Referring first to FIG. 1, there is designated generally by the arrow 10 a pumping well head structure wherein the upper end portion of an oil well pipe string is shown in the lower portion of the drawing at 11 connecting to a conventional manually operable Radigan valve 12. Shown above the pipe string 11 in axial alignment therewith is a stuffing box 13 from which a polished rod 14 extends. The polished rod 14 connects to a clamp on a carrier bar in turn connecting to a bridle on the rocking "horsehead" which reciprocates the polished rod up and down in a rectilinear manner. It will be understood that the lower end of the polished rod 14 connects to the pump sucker rods in the pipe string 11, the pump itself being located within the well at the lower end of the pipe string.

Oil pumped from the pipe string 11 is received through a flow line 15 provided with a control valve 16.

The foregoing described elements are normally connected together by a three-way fitting with a lower coupling communicating with the upper end of the pipe string through the Radigan valve 12, its axially aligned upper coupling receiving the stuffing box 13 and its lateral outlet connecting to the oil flow line 15.

In accord with the present invention, there is provided a four-way well head fitting 17 which is substituted for the normally provided three-way fitting. This four-way fitting 17 as shown in FIG. 1 has its lower end 18 coupled to the upper end of the pipe string 11 through the Radigan valve 12, its axially aligned upper end 19 receiving the stuffing box 13 through which the polished rod 14 extends and a lateral outlet 20 connecting to the oil flow line 15. The opposite lateral outlet is shown at 21 and receives a housing 22 incorporating various components making up the blow-out preventer.

It will be noted that the overall height of the well head structure is indicated at H. As mentioned, previously available blow-out preventers were inserted above the stuffing box 13 which increased this overall height. Because of the substitution of the four-way fitting 17 for the normally provided three-way fitting, there is no increase in the overall height H when utilizing the present invention.

Referring now to the fragmentary cross section of FIG. 2, further details of the blow-out preventer will be evident.

As shown in FIG. 2, the housing 22 includes external threads for connection to the opposite outlet of the four-way fitting and incorporates a sleeve 23 and seat bushing 24. A ball 25 is shown positioned at the outer end of the sleeve 23. A coiled compression spring 26 has one end seated on the seat bushing 24 and the other end bearing against the ball.

With the arrangement illustrated in FIG. 2, the ball 25 will be held against the end of the sleeve 23 by the polished rod 14, the ball simply bearing against this rod during its up and down reciprocating movement. Oil will thus flow up through the Radigan valve 12 as indicated by the arrows and out the lateral outlet 20 of the four-way fitting to the flow line. The stuffing box 13 will prevent passage of oil out the upper end of the stuffing box during reciprocating movement of the polished rod 14.

Should the polished rod 14 break or otherwise be ejected from the stuffing box 13, the ball 25 will be freed and the spring 26 will eject it towards the central portion of the four-way fitting 17. The ball will then seat against the underside of the stuffing box 13 thereby blocking oil flow through the stuffing box.

With respect to the foregoing, in order to avoid accidental movement of the ball 25 into the oil flow line; that is, through the lateral outlet 20, there is provided a diametric pin extending across this outlet 20 as indicated at 27.

Referring specifically to FIG. 3, the positioning of the diametric pin 27 in the outlet 20 will be evident and the presence of this pin will block the ball 25 from passing into the outlet flow line.

The foregoing described operation will be immediately evident with reference to FIG. 4 wherein the polished rod 14 has been illustrated in the lower portion of the drawing as broken, the upper portion of the rod having been ejected from the stuffing box 13. Under these conditions, the ball 25 is shown in solid lines seated against the lower entrance of the stuffing box 13 to thereby block oil flow so that the oil will be forced to continue to pass so long as it is under pressure to the oil flow line.

In FIG. 4, it will be evident that the positioning of the diametric pin 27 in the lateral outlet 20 prevents the ball 25 from passing in the flow line. Furthermore, the ball 25 cannot pass downwardly into the oil well pipe string because of the presence of the Radigan valve 12 wherein the gate valve blocks are sufficiently close together as to prevent passage of the ball.

From a re-examination of FIGS. 2 and 4, it will be evident that if the blow-out preventer is to function properly, careful adjustment of the position of the sleeve 23 relative to the polished rod 14 when the same is intact is important. In this respect, the ball 25 must engage lightly the side of the polished rod to "cage" or hold the ball in the front portion of the sleeve 23 with the spring 26 bearing against the same. The important dimensioning involved is the diameter of the polished rod and the diameter of the ball. The diameter of the ball is normally fixed at a value to properly seat against the lower end of the stuffing box 13 and thus for a different diameter of the polished rod, there must be an adjustment made in the positioning of the sleeve 23 and seat bushing 24 relative to the housing 22. In other words, if an oil well head polished rod is of greater diameter than that depicted in FIG. 2, the sleeve and seat bushing 23 and 24 respectively must be positioned further to the right within the housing 22 in order that the ball 25 will be properly "caged".

It will be noted in FIG. 4 that the sleeve 23 is press fitted or secured to the seat bushing 24 there being provided a pin 28 extending through the spring 26 to hold the spring in the seat bushing. The sleeve, seat bushing, pin and spring are thus fixed together as a unit.

To enable appropriate positioning of this structure axially in the housing 22 to accommodate larger diameter polished rods and thereby avoid the necessity of producing different sized blow-out preventers for different sized polished rods, the present invention contemplates the provision of a pipe section 29 which could be made of plastic material. This section 29 is arranged to be secured to a threaded opening 30 in the seat bushing 24, the extending end of the pipe section 29 seating on the interior rear end wall 31 of the housing 22. Preferably, this pipe section 29 has a hollow bore 32 so that pressure will be equalized on either side of the seat bushing 24.

With the foregoing arrangement, a user of the blow-out preventer will simply cut the pipe 29 to a length shorter than a given length L thereby permitting positioning of the seat bushing 24, sleeve 23 and spring 26 further in the housing 22 to accommodate the different diameter polished rod.

From all of the foregoing, it will thus be evident that the present invention has provided a greatly improved blow-out preventer which not only avoids increasing the overall height of the well head structure but in addition can be manufactured economically since use is made of the already provided stuffing box 13 as a valve seat. Moreover, because the components can be adjusted within housing 22 by appropriately cutting the pipe section 29 to a proper length in accord with the diameter of the polished rod, it is not necessary to produce different type structures but rather a uniformly produced product can be provided with the attendant advantages of economy.

I claim:

1. In a pumping well including a three-way well head fitting with a lower coupling to the lower end of a pipe string, an axially aligned upper coupling for receiving a stuffing box through which a polished rod in said pipe string passes and a lateral outlet connecting to an oil flow line for collecting pumped oil, an improved blow-out preventer for blocking oil from passing out said stuffing box from said pipe string in the event said polished rod should break or otherwise be ejected from said stuffing box, said blow-out preventer comprising, in combination:

(a) a four-way well heat fitting dimensioned to be substituted for said three way well head fitting so that the overall height of the well head structure is not increased, said four way well head fitting having a lower coupling for coupling to the upper end of said pipe string, an axially aligned upper coupling for receiving said stuffing box through which said polished rod extends, a lateral outlet connecting to said oil flow line and an opposite lateral outlet;

(b) a housing connected to said opposite lateral outlet;

(c) a sleeve received in said housing;

(d) a seat bushing secured to the inner end of said sleeve;

(e) a ball positioned at the outer end of said sleeve;

(f) a coiled compression spring in said sleeve with one end seated in said seat bushing and its other end bearing against said ball; and (g) a pipe section of given length secured to the end of said seat bushing opposite the end on which said spring seats and extending axially to engage the end wall of said housing and position said seat bushing at said given length from said end wall, whereby should said polished rod break or otherwise be ejected from said stuffing box, said ball is ejected into the central portion of said four-way fitting and urged against the lower entrance opening of said stuffing box by oil pressure to thereby block oil from passing through the stuffing box to the exterior of said well head and whereby said given length can be changed by cutting off the extending end portion of said pipe so that said seat bushing and sleeve can be positioned further in said housing closer to said end wall to accommodate the blow-out preventer to a pumping well having a larger diameter polished rod.

2. The subject matter of claim 1, in which a diametrically extending pin is provided in said lateral outlet in said four-way fitting connected to said oil flow line to block entrance of said ball into said flow line in the event of a blow-out.

* * * * *